United States Patent [19]

van Laar

[11] 4,356,468

[45] Oct. 26, 1982

[54] TRANSFORMER WITH MAGNETIC SCREENING FOILS

[75] Inventor: Jan van Laar, Eindhoven, Netherlands

[73] Assignee: U.S. Philips Corporation, New York, N.Y.

[21] Appl. No.: 154,563

[22] Filed: May 29, 1980

[30] Foreign Application Priority Data

Jun. 5, 1979 [NL] Netherlands ..... 7904379

[51] Int. Cl.[3] ..... H01F 15/04

[52] U.S. Cl. ..... 336/69; 336/84 R; 336/177; 336/178

[58] Field of Search ..... 336/69, 70, 84 R, 84 M, 336/84 C, 177, 222, 178

[56] References Cited

U.S. PATENT DOCUMENTS

| | | | |
|---|---|---|---|
| 343,602 | 6/1886 | Pfannkuche | 336/177 X |
| 1,159,226 | 11/1915 | Johannesen | 336/177 X |
| 2,170,048 | 8/1939 | Dunning et al. | 336/84 C X |
| 2,553,324 | 5/1951 | Lord | 336/177 X |
| 4,060,784 | 11/1977 | Fergestad | 336/84 R |

*Primary Examiner*—Thomas J. Kozma

*Attorney, Agent, or Firm*—Thomas A. Briody; Robert T. Mayer; Bernard Franzblau

[57] ABSTRACT

A transformer comprising a plurality of conductive screening foils located between the core and the windings and between the primary and secondary windings. In order to prevent eddy current losses in the screening foils, at least the first screening foil is made of a soft-magnetic material.

12 Claims, 1 Drawing Figure

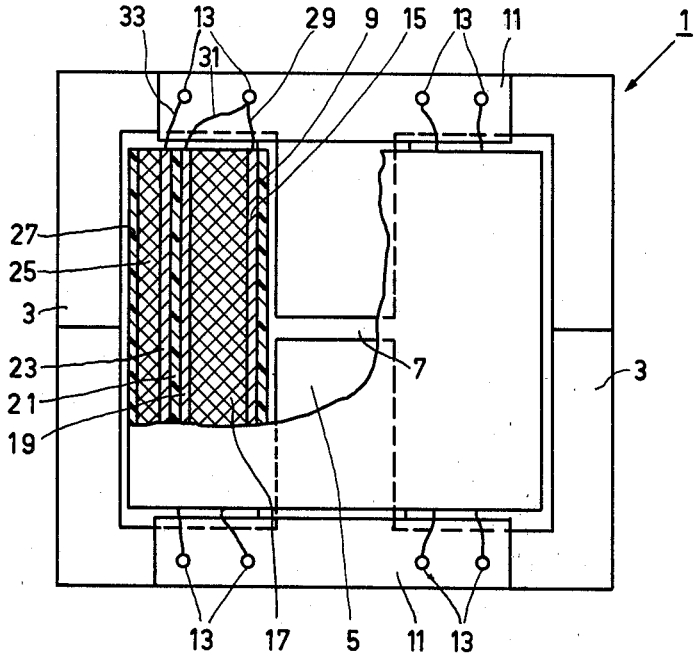
33
13
29
9
15
13
11
1
31
27
25
3
23
21
19
7
3
13
17
5
11
13

TRANSFORMER WITH MAGNETIC SCREENING FOILS

The invention relates to a transformer comprising a ferromagnetic core having one leg which supports a primary winding and at least one secondary winding with said windings being coaxial and insulated from each other, and between the windings and said leg and also between the primary and the secondary windings there are provided conductive screening foils which comprise electrical connections.

Transformers of this kind are used, for example, in switched mode power supplies with mains isolation. The screening foils serve for the capacitive screening of the primary and secondary windings so that the high-frequency voltages occurring therein cannot cause external interference. To this end, part of the screening foils is primarily grounded via the connections and another part is secondarily grounded. When a large magnetic flux is present at the area of the screening foils, for example, because the leg on which the windings are accommodated comprises an air gap, substantial eddy current losses occur in the screening foils.

An object of the invention is to provide a transformer of the described kind in which such eddy current losses in the screening foils are substantially smaller. To this end, the transformer in accordance with the invention is characterized in that at least the screening foil which is situated between the windings and the core leg is made of a soft-magnetic material.

The invention is based on the intuitive perception that the flux which crosses from the air gap to the other legs of the core can be substantially reduced by making at least the first screening foil thicker than the electromagnetic penetration depth. For non-ferromagnetic materials such as copper, the penetration depth is generally so large that very thick and hence expensive foils which are difficult to wind are required. Screening foils made of soft-magnetic materials, however, offer excellent results, even in the case of a small thickness.

It is to be noted that magnetic screens are known per se, for example, from German Auslegeschrift No. 1,237,677 and French patent specification No. 894,466. However, these references are not concerned with screening foils comprising electrical connections for capacitive screening.

A preferred embodiment of the transformer in accordance with the invention is characterized in that the screening foils are made of a soft-magnetic material and are covered with a layer of a material which is highly electrically conductive.

A step of this kind is known for the formation of short-circuited turns on a magnetic screen, see IBM Technical Disclosure Bulletin, Vol 12, Nr. 10 (March 1970), pp 1623–1624.

The invention will be described in detail hreinafter with reference to the accompanying diagrammatic drawing. The drawing is a side elevation and a partial sectional view of an embodiment of a transformer in accordance with the invention.

The transformer comprises a ferromagnetic core 1 which consists of two halves and which is made, for example, of ferrite, said core comprising two outer legs 3 and a central leg 5 which comprises an air gap 7 in order to prevent excessively fast saturation of the core. Around the central leg 5 there is arranged an insulating coil former 9 on which connection blocks 11 are formed, metal connection pins 13 being secured in said connection blocks 11.

Around the coil former 9 there are successively coaxially wound: a first conductive screening foil 15 made of a soft-magnetic material, a primary winding 17, a second conductive screening foil 19 also made of a soft-magnetic material, a first insulating foil 21 made of a synthetic material, a third conductive screening foil 23 made of a soft-magnetic material, a secondary winding 25, and a second insulating foil 27 made of a synthetic material.

The first and second screening foils 15 and 19 are connected, via connection wires 29 and 31, to a common connection pin 13 which, when the transformer is built into a circuit, is grounded on the primary side. The third screening foil 23 is connected, via a connection wire 33, to another connection pin 13 which is grounded on the secondary side. As a result, the primary and secondary windings 17 and 25 are capacitively screened so that no disturbing electromagnetic radiation can escape into the environment.

Because the screening foils 15, 19, 23 are made of a soft-magnetic material, their thickness, which itself is comparatively small (for example, approximately 50 μm), is larger than the electromagnetic penetration depth for the frequency used (for example, approximately 300 kHz), so that magnetic flux cannot cross from the air gap 7, via the screening foils, to the outer legs 3. Eddy current losses are thus prevented in the screening foils. The screening foils may be made of, for example, mumetal or amorphous iron. In order to improve the conductivity, they may be covered, if desired, with a layer of a highly electrically conductive material, for example, tin.

Even though it is generally sufficient for the prevention of eddy current losses that only the first screening foil 15, which is situated between the leg 5 and the windings 17, 25, be made of a soft-magnetic material, it may be advantageous for the simplification of the manufacturing process to make all of the screening foils 15, 19, 23 of this material, as in the described embodiment.

What is claimed is:

1. A transformer comprising a ferromagnetic core having one leg which supports a primary winding and at least one secondary winding, said windings being coaxial and insulated from each other, an electrically conductive screening foil positioned between the windings and said core leg and made of a soft-magnetic material, and electrically conductive screening foil means located beteen the primary and the secondary windings, and wherein the screening foil and the screening foil means are electrically connected to connection leads.

2. A transformer as claimed in claim 1, characterized in that the screening foil which is made of a soft-magnetic material is covered with a layer of highly electrically conductive material.

3. A transformer as claimed in claims 1 or 2 wherein the screening foil means comprises second and third electrically conductive screening foils each made of a soft-magnetic material and positioned between the primary and secondary windings and insulated from each other.

4. A transformer as claimed in claim 3 wherein at least one of said second and third screening foils comprises a soft-magnetic material covered with a layer of a highly electrically conductive material.

5. A transformer as claimed in claims 1 or 2 wherein the transformer core comprises at least two core legs and wherein said one core leg includes an air gap therein.

6. A transformer as claimed in claim 3 wherein the second and third screening foils are electrically connected to connection leads, and means connecting the connection leads from the first and second screening foils together to a common transformer terminal and the connection lead from said third screening foil to a second transformer terminal.

7. A transformer comprising a ferromagnetic core having a plurality of core legs one of which includes an air gap therein, a primary winding and a secondary winding supported on said one core leg with said windings arranged in coaxial relationship and insulated from one another, a first electrically conductive screening foil positioned between said one core leg and said windings and made of a soft-magnetic material, and second and third electrically conductive screening foils located on said one core leg between said primary and secondary windings.

8. A transformer as claimed in claim 7 wherein at least one of said second and third screening foils comprises a soft-magnetic material.

9. A transformer as claimed in claims 7 or 8 further comprising means for connecting the first and second screening foils to ground on the primary winding side of the transformer and the third screening foil to ground on the secondary winding side of the transformer thereby to provide a capacitive screening effect for said windings that inhibits the escape of electromagnetic radiation into the surrounding environment.

10. A transformer as claimed in claims 7 or 8 wherein said screening foils are arranged in coaxial relationship with said windings and further comprising an insulating foil coaxially arranged between said second and third screening foils, and means connecting said first and second screening foils in common to a first terminal of the transformer and the third screening foil to a second terminal of the transformer.

11. A transformer as claimed in claims 7 or 8 wherein the screening foils made of a soft-magnetic material are covered with a layer of a highly electrically conductive material.

12. A transformer as claimed in claim 7 wherein said first screening foil is made of mumetal or amorphous iron.

* * * * *